US005580159A

United States Patent [19]

Liu

[11] Patent Number: 5,580,159

[45] Date of Patent: Dec. 3, 1996

[54] MINIATURE LIGHT FIXTURE

[75] Inventor: Ivan Liu, Markham, Canada

[73] Assignee: Noma, Inc., Toronto, Canada

[21] Appl. No.: 421,365

[22] Filed: Apr. 12, 1995

[51] Int. Cl.[6] ..... F21P 1/02; H01R 33/00

[52] U.S. Cl. ..... 362/226; 362/249; 362/806; 439/356; 439/375

[58] Field of Search ..... 362/123, 226, 362/806, 249, 457; 439/356, 375, 680, 702, 707, 734

[56] References Cited

U.S. PATENT DOCUMENTS

| | | | |
|---|---|---|---|
| 4,631,650 | 12/1986 | Abroni | 362/806 X |
| 4,679,126 | 7/1987 | Van Sickler | 362/226 |
| 4,704,669 | 11/1987 | Brunner | 362/226 X |
| 4,999,751 | 3/1991 | Chen | 362/226 |
| 5,192,127 | 3/1993 | Schaef | 362/226 |
| 5,331,529 | 7/1994 | Huang | 362/226 |
| 5,339,232 | 8/1994 | Lin | 362/226 X |
| 5,418,698 | 5/1995 | Wu | 362/226 X |

*Primary Examiner*—Denise Gromada
*Assistant Examiner*—Thomas M. Sember
*Attorney, Agent, or Firm*—Kirschstein, et al.

[57] ABSTRACT

A miniature light fixture includes a miniature light bulb, an elongated folding element having a recess that receives a base portion of the light, and a socket bounding an internal passage for partially receiving the holding element in an assembled condition of the fixture. At least one hook-shaped projection to be used to effect extraction of the holding element out of the passage of the socket extends axially beyond an end portion of the holding element that is situated outside the passage in the assembled condition and includes an outwardly extending engageable nose on its free end. At least one protuberance and at least one associated depression are disposed on respective zones of the holding element and of a circumferential wall of the socket that are juxtaposed with one another in the assembled condition in which the depression receives the protuberance. The circumferential wall has at least one pair of open-ended slots flanking its respective zone and circumferentially separating the same from the remainder of the circumferential wall to enable such zone to flex without impedance from circumferentially adjacent regions of the circumferential wall. The protuberance has a wedge-shaped configuration in that it is outwardly delimited by an axially sloping ramp surface.

11 Claims, 1 Drawing Sheet

FIG. 1
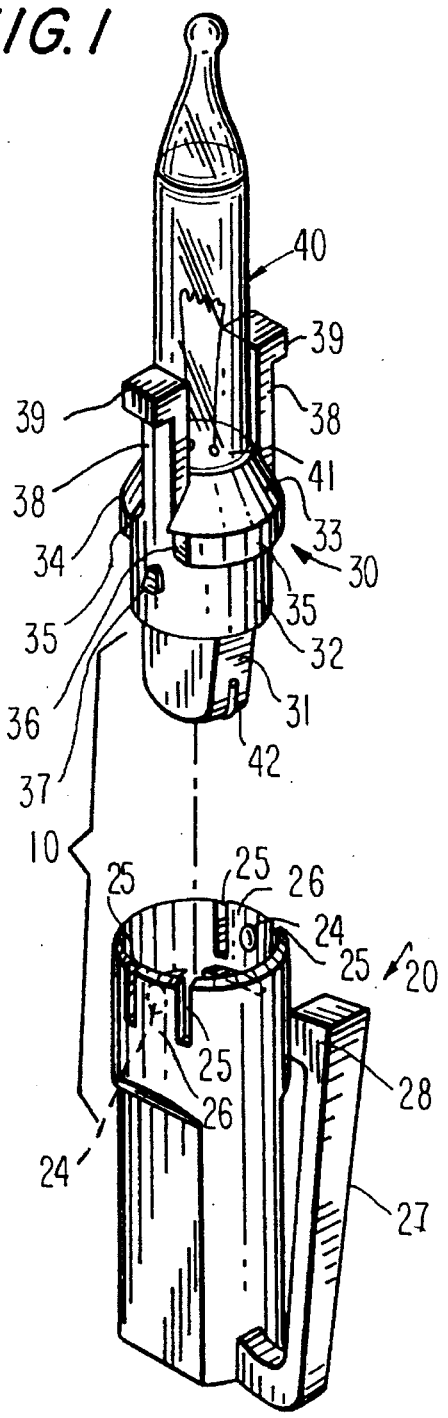
FIG. 2
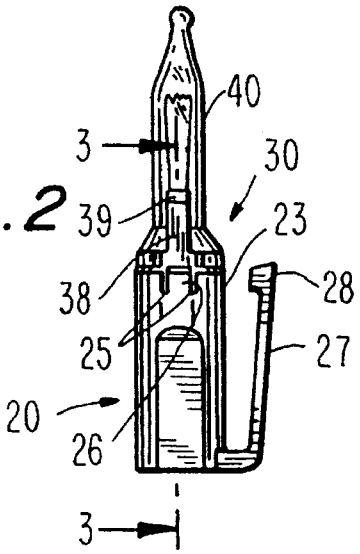
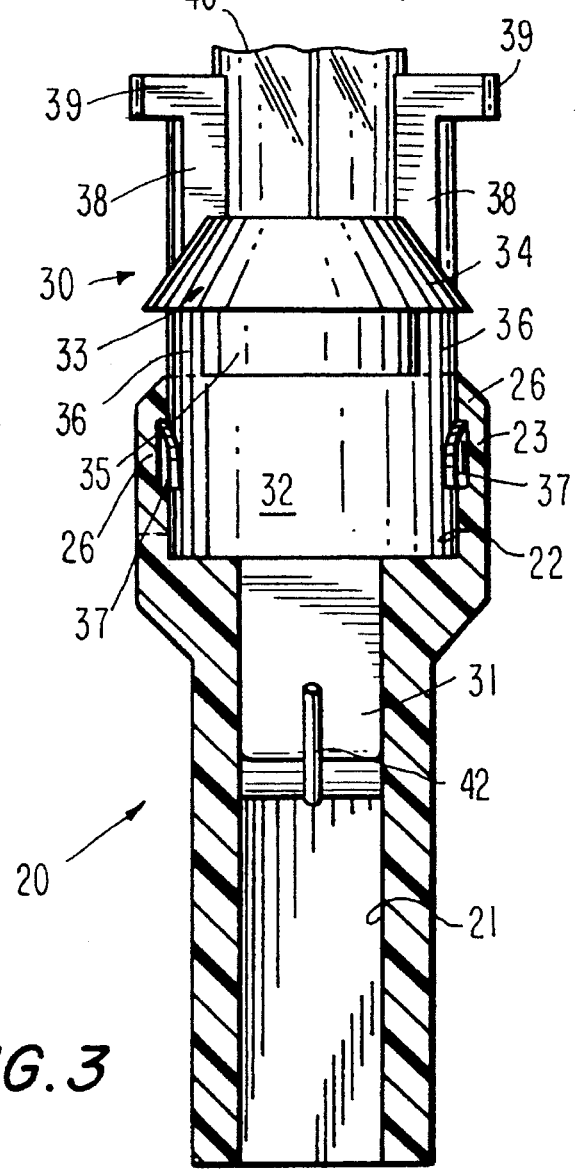
FIG. 3

MINIATURE LIGHT FIXTURE

BACKGROUND OF THE INVENTION

1. Field of the Invention

The present invention relates to decorative lighting in general, and more particularly to a miniature light fixture.

2. Description of the Related Art

There are already known various constructions of light fixtures, among them so-called miniature light fixtures that are usually used in miniature light sets or strings each including a multitude of such light fixtures distributed along and electrically interposed in series in an electrical conductor or wire arrangement. Examples of various constructions and structural features of such miniature light fixtures can be found, for instance, in U.S. Pat. No. 4,298,923 to Lin; U.S. Pat. No. 4,779,177 to Ahroni; U.S. Pat. No. 4,999,751 to Chen; and U.S. Pat. No. 5,278,741 to Ehrman. What these known devices and others like them have in common is that each of them includes an electrical socket and a holding element that holds a light bulb and is pushed during assembly into, and thereafter retained in one way or another in, an internal passage of the socket to establish an electrical connection between electrical leads or contacts of the light bulb and associated terminals disposed in the passage of the socket.

Experience with miniature lights of this kind has shown, however, that it is rather difficult to extract the holding element from the passage, for instance, when a faulty light bulb is to be replaced, or an interrupted electrical connection is to be reestablished, especially because it is difficult to grip the holding element with a force that is sufficient for effectuating such extraction. Thus, this operation is very cumbersome to say the least, and often requires the use of tools that may not be readily available. This, of course, is quite disadvantageous, not only because the execution of such an operation requires a substantial amount of time, but also, because it constitutes a source of a substantial frustration and annoyance to the user who may switch loyalty to another brand the next time.

Light fixtures of a different yet in certain respects similar kind, some of them including laterally situated hooks on their sockets, are disclosed in the British Patent No. 1,055,631 to Howles, et al. and in U.S. Pat. No. 4,667,270 to Yagi; U.S. Pat. No. 4,667,276 to Cheng; U.S. Pat. No. 4,940,422 to Forish, et al.; and U.S. Pat. No. 5,361,192 to Lai. However, to the extent that the extraction problem discussed above is present in these arrangements to begin with, if at all, such references do not contain any suggestions as to how it could be addressed and/or solved.

OBJECTS OF THE INVENTION

Accordingly, it is a general object of the present invention to avoid the disadvantages of the prior art.

More particularly, it is an object of the present invention to provide a miniature light fixture that does not possess the drawbacks of the known light fixtures of this type.

Still another object of the present invention is to devise a miniature light fixture of the type here under consideration that would be easy to assemble and disassemble while the various components thereof are securely retained in their assembled condition against accidental relative movements.

It is yet another object of the present invention to design the above miniature light fixture in such a manner as to greatly facilitate, as compared to the state of the art, the extraction of a holding element of the fixture out of a passage of an associated electric socket.

A concomitant object of the present invention is so to construct the miniature light fixture of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a miniature light fixture that includes, as its main components, a miniature light bulb, an elongated holding element and a socket. The holding element bounds a recess that receives a base portion of the light bulb, and has first and second end portions and an intervening central portion. The socket bounds an internal passage for receiving the central and first end portions of the holding element in an assembled condition of the fixture. The passage of the socket has at least one dimension that is smaller than a corresponding dimension of the second end portion of the holding element to prevent entry of the second end portion into the passage.

According to the present invention, there is further provided means for facilitating extraction of the central and first end portions of the holding element out of the passage of the socket, such facilitating means including at least one hook-shaped projection forming an extension of the second end portion of the holding element in a direction away from the central portion. The hook-shaped projection has an outwardly extending engageable nose on its free end that is situated remotely from the central portion of the holding element. A particular advantage of the construction of the miniature light fixture as described so far is that the hook-shaped projection, due to its relatively large axial dimension and/or the presence of the outwardly extending nose on its free end portion, is relatively easy to grip and engage with a force sufficient to effectuate the extraction, without slippage between the holding element and the fingers of the user. This feature of the present invention finds a particularly advantageous application when the facilitating means further includes at least one additional hook-shaped projection substantially identical to the one hook-shaped projection and circumferentially spaced therefrom, especially when the additional hook-shaped projection is situated substantially opposite the one hook-shaped projection, as also proposed by the present invention.

The socket has a circumferential wall that bounds a portion of the passage that receives the central portion of the holding element in the assembled condition, and there is further provided means for latching the holding element and the socket in their assembled condition, such latching means including at least one protuberance and at least one associated depression disposed one on the central portion and the other on the circumferential wall at respective zones that are juxtaposed with one another in the assembled condition for the depression to receive the protuberance.

According to another facet of the present invention, the circumferential wall of the socket includes at least one pair of open-ended slots flanking the respective one of the aforementioned zones and circumferentially separating the same from the remainder of the circumferential wall to enable such zone to flex outwardly during movement of the holding element into and out of the assembled condition without impedance from circumferentially adjacent regions of the remainder of the circumferential wall.

It is particularly advantageous in this respect when the latching means further includes at least one additional protuberance and at least one additional associated depression similar to the one protuberance and the one depression, but disposed at respective additional juxtaposed zones that are circumferentially spaced from the first-mentioned zones in the assembled condition, and when the circumferential wall of the socket includes at least one additional pair of open-ended slots flanking the additional zone and circumferentially separating the same from the remainder of the circumferential wall, especially when the additional zones are situated substantially diametrically opposite the first-mentioned zones. The ease of extraction and/or insertion is further enhanced by giving at least the protuberance a wedge-shaped configuration by outwardly delimiting the same by an axially sloping ramp surface.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a perspective view of a miniature light fixture of the present invention in its disassembled condition;

FIG. 2 is a side elevational view, at a reduced scale, of the light fixture of FIG. 1, in its assembled condition; and FIG. 3 a sectional view of the light fixture taken on line 3—3 of FIG. 2 and drawn on a scale exceeding even that of FIG. 1.

DETAILED DESCRIPTION OF THE PREFERRED EMBODIMENT

Referring now to the drawing in detail, and first to FIG. 1 thereof, it may be seen that the reference numeral 10 has been used therein to identify a miniature light fixture of the present invention in its entirety. The light fixture 10 includes, as its main components, a socket 20 and a light bulb holding element 30 that has a miniature light bulb 40 mounted thereon. Before going into detailed discussion of the construction and operation of the light fixture 10 and its components 20, 30 and 40, it is to be mentioned that whenever reference is being had herein to directions such as "up" or "down", to relative positions such as "upper" or "lower", or directionally related attributes such as "bottom" or "top", it is only in relation to the orientation shown in the drawings and it has no other significance whatsoever and no absolute meaning because the light fixture 10 need not even be used in that orientation.

The manner in which the light bulb 40 is mounted on the holding element 30 and electrically connected to non-illustrated electric wires for supplying electric current to the light bulb 40 when the latter is to be lit is not different from that typically or frequently used in known miniature light sets, so that it will not be discussed here in any great detail. Suffice it to say that the light bulb 40 includes a base portion indicated at 41 that is received in a substantially complementarily configured recess of the holding element 30, and two electric leads 42 only one of which is shown in FIGS. 1 and 3. The electric leads 42 pass though an appropriately configured bottom portion 31 of the holding element 30, preferably via separate orifices, and are bent about opposite sides of the bottom portion 31 to form respective electric contacts thereat. When the miniature light fixture 10 is fully and properly assembled, the thus formed electric contacts engage corresponding electric terminals that are connected to the aforementioned electric wires and arranged, in a manner that is not illustrated because it is conventional, at appropriate locations of a bottom region of a passage 21 formed in the socket 20 to establish respective electrical connections with such terminals.

The holding element 30 further includes a central portion 32 and an upper portion 33. The central portion 32 is substantially fittingly received in a portion 22 of the passage 21, while the upper portion 33 extends out of the passage 21 and upwardly of the socket 20 and has at least some dimensions exceeding the corresponding dimensions of the passage 21 so that no region of the upper portion 33 can be pushed into the passage 21.

More particularly, the upper portion 33 is shown to include a frustoconical upper section 34 and two ribs 35 integral with the frustoconical section 34, forming part-cylindrical downward extensions thereof, and separated from one another by respective gaps 36. As shown, at the regions of the gaps 36, the upper portion 33 has substantially the same diameter as the central potion 32. As a result of this construction, the ribs 35 are situated very close to, if not in abutment with, an upper end portion 23 of the socket 20. This makes it difficult if not impossible to engage the upper portion 33 of the holding element 30 from below when it is desired to disassemble the holding element 30 from the socket 20, such as for the purpose of replacing the light bulb 40, without employing special tools.

This disassembly is rendered even more difficult by the fact that the holding element 30 is held in its assembled position with respect to the socket 20 by respective protuberances 37 provided at circumferentially spaced locations on the outer periphery of the central portion 32 and received in associated detents or depressions 24 situated in the upper region 22 of the passage 21 of the socket 20. While the engagement of the protuberances 37 with the surfaces bounding the depressions 24 serves the useful purposes of not only preventing accidental dissociation of the holding element 30 from the socket 20, but also of preventing relative shifting thereof to a lesser extent which, however, would still bring at least one of the aforementioned contacts out of contact with its associated terminal, it provides an additional resistance to any deliberate effort to pull the holding element 30 out of the socket 20.

To alleviate if not eliminate the above problems, the upper portion 33 of the holding element 30 is shown to be equipped, at the regions of the gaps 36, with respective engaging portions 38 projecting upwardly therefrom along the light bulb 40. Each of the engaging portions 38 is shown to extend along a substantially L-shaped course, that is, it has an outwardly projecting nose 39. This greatly facilitates the disassembly in that the user is able to simply grip the engaging portions 38 and/or engage the noses 39 from below and then exert the forces needed to effectuate the disassembly without losing grip on the holding element 30.

Further facilitation of the disassembly is achieved by providing in the upper end portion 23 of the socket 20 two pairs of vertically extending slots 25 flanking respective zones 26 of the upper end portion 23 that include the depressions 24 and separating them partially (just circumferentially) from the remainder of the upper end portion 23. The provision of these slots 25 interrupts the continuity of the upper end portion 23 in the circumferential direction and thus renders it much easier than in their absence for the zones 26 to resiliently flex out and back in as the holding element 30 is being either withdrawn from or introduced into the passage 21, without impedance from the circumferentially adjacent regions of the upper end portion 23. This flexing, in turn, provides for desirably easy displacement of the zones 26 out of the paths of relative movement of the protuberances 37 while the latter are in the upper portion 22 of the passage 21 and at least partially out of the respective depressions 24.

This task is made even easier when the protuberances 37 are given wedge-shaped configurations, rather than the usual part-spherical or hemispherical ones. Their outer surfaces slope in the axial direction, advantageously in the manner observable especially in FIG. 1 of the drawing. This makes it relatively easy for the respective protuberance 37 to slide out of the associated depression 24 in that no big step needs to be overcome within a short distance as the central portion 32 is being pulled out of the upper portion 22 of the passage 21.

Yet, inasmuch as the overall height of the respective wedge-shaped protuberance 37 can be made the same as or even greater than if the protuberance 37 had a part-spherical configuration, the amount of effort required to flex the zone 26 out of the way to the extent required to make the highest point of the wedge-shaped protuberance 37 leave the depression 24 is just about the same as if the protuberance 37 had the latter configuration. Yet, the fact that the presence of the protuberances 37 results in an interference fit between the socket 20 and the holding element 20 still strongly militates against accidental axial movement of the holding element 30 relative to the socket 20 despite the relative ease with which the intended axial movement can be accomplished. In any event, the resistance to withdrawal of the holding element 30 out of the passage 21 can be tailored, with only a minimum effort, by appropriately choosing the lengths of the slots 25 and their mutual spacing and/or by selecting the slope of the external or ramp surfaces of the protuberances 37, to achieve the minimum amount of it required for safe retention of the holding element 30 in the socket 20 against unintentional movement.

It may also be observed in FIGS. 1 and 2 of the drawing that the socket 20 as depicted is further equipped with a hook-shaped projection 27 extending from the bottom portion of the socket 20 upwardly to about the elevation of the top of the upper end portion 23 of the socket 20. This hook 27 is employed for mounting the fixture 10 on or suspending the same from a support, such as a Christmas or other tree branch, a garland, a mounting wire or the like. The hook 27, like the remainder of the socket 20 and, as a matter of fact, even the holding element 30, is made of an elastically yieldable or flexible material, especially one of the synthetic plastic material variety. This means that, depending on the transverse dimension of diameter of the support, the hook 27 can be flexed out to permit passage of the support through the thus enlarged mouth of the free space existing between the hook 27 and the outer peripheral surface of the remainder of the socket 20 into or out of such space and even to confine or clamp the support between itself and such outer peripheral surface. To reduce the danger that the so mounted fixture 10 would be able to become accidentally dissociated from the support, the hook 27 is provided with an inwardly projecting promontory 28 that decreases the size of the aforementioned mouth and thus requires an increased amount of effort for flexing the hook 27 out of the way, such extra amount of energy usually not being available during unintended events or actions.

It will be understood that each of the elements described above, or two or more together, may also find a useful application in other types of constructions differing from the type described above.

While the present invention has been described and illustrated herein as embodied in a specific construction of an easily disassemblable miniature light fixture, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A miniature light fixture comprising:

a) a miniature light bulb having a base portion;

b) an elongated holding element having a recess for receiving said base portion of said light bulb and having first and second end portions and an intervening central portion;

c) a socket bounding an internal passage for receiving said central and first end portions of said holding element in an assembled condition of the fixture, said passage having at least one dimension smaller than a corresponding dimension of said second end portion of said holding element to prevent entry thereof into said passage, said socket having a circumferential wall bounding a portion of said passage that receives said central portion of said holding element in said assembled condition;

d) means for latching said holding element and said socket in said assembled condition thereof, including at least one protuberance and at least one associated depression disposed, one on said central portion, and the other on said circumferential wall, at respective zones thereof that are juxtaposed with one another in said assembled condition for said depression to receive said protuberance, said circumferential wall of said socket including at least one pair of open-ended slots flanking said zone thereof and circumferentially separating said zone from a remainder of said circumferential wall to enable said zone to flex outwardly during movement of said holding element into and out of said assembled condition without impedance from circumferentially adjacent regions of said remainder of said circumferential wall; and e) means for facilitating extraction of said central and first end portions of said holding element out of said passage of said socket, including at least one hook-shaped projection forming an extension of said second end portion of said holding element in a direction away from said central portion, said projection having an outwardly extending engageable nose on a free end thereof that is situated remotely from said central portion.

2. The miniature light fixture as defined in claim 1, wherein said facilitating means further includes at least one additional hook-shaped projection substantially identical to said one hook-shaped projection and circumferentially spaced therefrom.

3. The miniature light fixture as defined in claim 2, wherein said additional hook-shaped projection is situated substantially opposite said one hook-shaped projection.

4. The miniature light fixture as defined in claim 1, wherein said latching means further includes at least one additional protuberance and at least one additional associated depression similar to said one protuberance and said one depression but disposed at respective additional juxtaposed zones that are circumferentially spaced from said zones in said assembled condition; and wherein said circumferential wall of said socket includes at least one additional pair of open-ended slots flanking said additional zone thereof and circumferentially separating said additional zone from a remainder of said circumferential wall.

5. The miniature light fixture as defined in claim 4, wherein said additional zones are situated substantially diametrically opposite said zones.

6. The miniature light fixture as defined in claim 1, wherein said zone of said holding element is substantially axially aligned with said hook-shaped projection.

7. The miniature light fixture as defined in claim 1, wherein at least said protuberance has a wedge-shaped configuration, being outwardly delimited by an axially sloping ramp surface.

8. A miniature light fixture comprising:

a) a miniature light bulb having a base portion;

b) an elongated holding element having a recess for receiving said base portion of said light bulb and having first and second end portions and an intervening central portion;

c) a socket including a circumferential wall bounding an internal passage for receiving said central and first end portions of said holding element in an assembled condition of the fixture, said passage having at least one dimension smaller than a corresponding dimension of said upper portion of said holding element to prevent entry thereof into said passage; and d) means for latching said holding element and said socket in said assembled condition thereof, including at least one protuberance and at least one associated depression disposed, one on said central portion, and the other on said circumferential wall, at respective zones thereof that are juxtaposed with one another in said assembled condition for said depression to receive said protuberance; and wherein said circumferential wall of said socket includes at least one pair of open-ended slots, each slot extending entirely through said circumferential wall of said socket, said slots flanking said zone thereof and circumferentially separating said zone from a remainder of said circumferential wall to enable said zone to flex outwardly during movement of said holding element into and out of said assembled condition without impedance from circumferentially adjacent regions of said remainder of said circumferential wall.

9. The miniature light fixture as defined in claim 8, wherein said latching means further includes at least one additional protuberance and at least one additional associated depression similar to said one protuberance and said one depression but disposed at respective additional juxtaposed zones that are circumferentially spaced from said zones in said assembled condition; and wherein said circumferential wall of said socket includes at least one additional pair of open-ended slots, each slot extending entirely through said circumferential wall of said socket, said slots flanking said additional zone thereof and circumferentially separating said additional zone from a remainder of said circumferential wall.

10. The miniature light fixture as defined in claim 9, wherein said additional zones are situated substantially diametrically opposite said zones.

11. The miniature light fixture as defined in claim 9, wherein at least said protuberance has a wedge-shaped configuration, being outwardly delimited by an axially sloping ramp surface.

* * * * *